US005858263A

United States Patent [19]

Geary

[11] Patent Number: 5,858,263

[45] Date of Patent: Jan. 12, 1999

[54] ICE PUCK MOLD AND STORAGE SYSTEM

[76] Inventor: Patrick W. Geary, 244 Wildflower La., Somerville, N.J. 08876

[21] Appl. No.: 967,988

[22] Filed: Nov. 12, 1997

[51] Int. Cl.[6] ..... F25C 1/22; B65D 69/00

[52] U.S. Cl. ..... 249/120; 206/575; 249/119; 249/126

[58] Field of Search ..... 249/119, 120, 249/126; 206/575

[56] References Cited

U.S. PATENT DOCUMENTS

| | | | |
|---|---|---|---|
| 1,231,569 | 7/1917 | Coshland | 249/126 |
| 2,132,248 | 10/1938 | Toyne | 249/126 |
| 2,961,850 | 11/1960 | Tupper | 249/126 |
| 3,129,568 | 4/1964 | Knepper | 249/126 |
| 3,565,389 | 2/1971 | Price | 249/126 |
| 3,921,801 | 11/1975 | Sway | 249/121 |
| 4,815,691 | 3/1989 | Cooley | 249/120 |
| 5,397,097 | 3/1995 | Dale | 249/120 |
| 5,676,875 | 10/1997 | Kelley | 249/120 |

*Primary Examiner*—James P. Mackey

[57] ABSTRACT

A ice puck mold and storage system is provided including at least one hockey puck mold having a circular bottom face and a cylindrical periphery integrally coupled thereto and extending upwardly therefrom for defining an upper peripheral edge, an interior space, and an open top.

7 Claims, 2 Drawing Sheets

ICE PUCK MOLD AND STORAGE SYSTEM

BACKGROUND OF THE INVENTION

1. Field of the Invention

The present invention relates to a ice puck mold and storage system and more particularly pertains to making ice pucks and storing the same prior to use while practicing hockey.

2. Description of the Prior Art

The use of ice molds is known in the prior art. More specifically, ice molds heretofore devised and utilized for the purpose of generating ice of various shapes are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,905,957; U.S. Pat. No. 5,366,219; U.S. Pat. No. Des. 361,610; U.S. Pat. No. 5,198,127; U.S. Pat. No. 4,974,809; and U.S. Pat. No. 4,268,002.

In this respect, the ice puck mold and storage system according to the present invention substantially departs from the conventional concepts and designs of the prior art, and in so doing provides an apparatus primarily developed for the purpose of making ice pucks and storing the same prior to use while practicing hockey.

Therefore, it can be appreciated that there exists a continuing need for a new and improved ice puck mold and storage system which can be used for making ice pucks and storing the same prior to use while practicing hockey. In this regard, the present invention substantially fulfills this need.

SUMMARY OF THE INVENTION

In view of the foregoing disadvantages inherent in the known types of ice molds now present in the prior art, the present invention provides an improved ice puck mold and storage system. As such, the general purpose of the present invention, which will be described subsequently in greater detail, is to provide a new and improved ice puck mold and storage system which has all the advantages of the prior art and none of the disadvantages.

To attain this, the present invention essentially comprises a container. As best shown in FIG. 3, the container has an inner extent having a circular bottom and a cylindrical periphery integrally coupled thereto and extending upwardly therefrom. As such, an interior space and an open top face are defined. The periphery of the inner extent has a plurality of threaded grooves formed therein adjacent to the open top face. For reasons that will soon become apparent, an annular flange is mounted to a top surface of the bottom adjacent to the periphery. The container further includes an outer extent having a circular bottom and a cylindrical periphery integrally coupled thereto and extending upwardly therefrom. The outer extent has an enlarged interior space and an upper peripheral edge integrally coupled to the periphery of the inner extent. Such coupling is effected just below the threaded grooves. By this structure, a uniform space resides between the inner extent and the outer extent. The space is preferably lined with insulation. For carrying purposes, the container further includes a vertically oriented handle comprising an elongated rectangular strip. The strip is mounted to the periphery of the outer extent via a pair of bevelled stanchions. Further provided is a cap having a top face and a periphery extending downwardly therefrom with a plurality of threaded grooves formed therein. The grooves of the cap are thus adapted for removably coupling with those of the container. For facilitating the coupling of the cap with the container, the top face has a rectangular strip integrally coupled thereto. Finally, a plurality of hockey puck molds are provided each having a circular bottom face and a cylindrical periphery integrally coupled thereto and extending upwardly therefrom. An upper peripheral edge, an interior space and an open top are thereby defined. A diameter of the periphery of each mold is about equal to that of the periphery of the inner extent of the container. For maintaining the molds in a stacked relationship, the periphery of each mold is equipped with an upper peripheral edge having an annular lip integrally coupled thereto and extending upwardly therefrom. The annular lip is situated contiguous with an outer surface of the periphery of the mold and has a reduced thickness as compared to the periphery of the corresponding mold. Associated therewith is a lower annular cutout formed in a bottom edge of the periphery of each mold. During use, the molds may be slidably situated within the interior space of the inner extent of the container in a stacked relationship. As shown in FIG. 3, the annular lip is removably mounted within the annular cutout of an adjacent mold.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ice puck mold and storage system which has all the advantages of the prior art ice molds and none of the disadvantages.

It is another object of the present invention to provide a new and improved ice puck mold and storage system which may be easily and efficiently manufactured and marketed.

It is a further object of the present invention to provide a new and improved ice puck mold and storage system which is of a durable and reliable construction.

An even further object of the present invention is to provide a new and improved ice puck mold and storage system which is susceptible of a low cost of manufacture with regard to both materials and labor, and which accordingly is then susceptible of low prices of sale to the consuming public, thereby making such ice puck mold and storage system economically available to the buying public.

Still yet another object of the present invention is to provide a new and improved ice puck mold and storage system which provides in the apparatuses and methods of the prior art some of the advantages thereof, while simultaneously overcoming some of the disadvantages normally associated therewith.

Still another object of the present invention is to make ice pucks and store the same prior to use while practicing hockey.

Lastly, it is an object of the present invention to provide a new and improved ice puck mold and storage system including at least one hockey puck mold having a circular bottom face and a cylindrical periphery integrally coupled thereto and extending upwardly therefrom for defining an upper peripheral edge, an interior space, and an open top.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
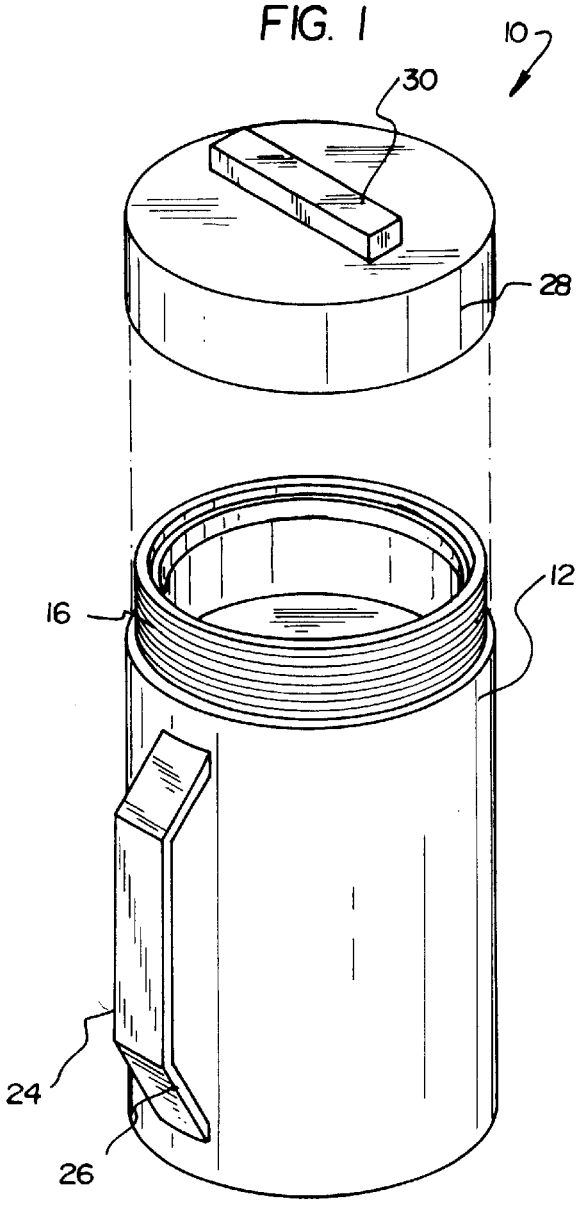
FIG. 1 is a perspective illustration of the preferred embodiment of the ice puck mold and storage system constructed in accordance with the principles of the present invention.
Figure 2:
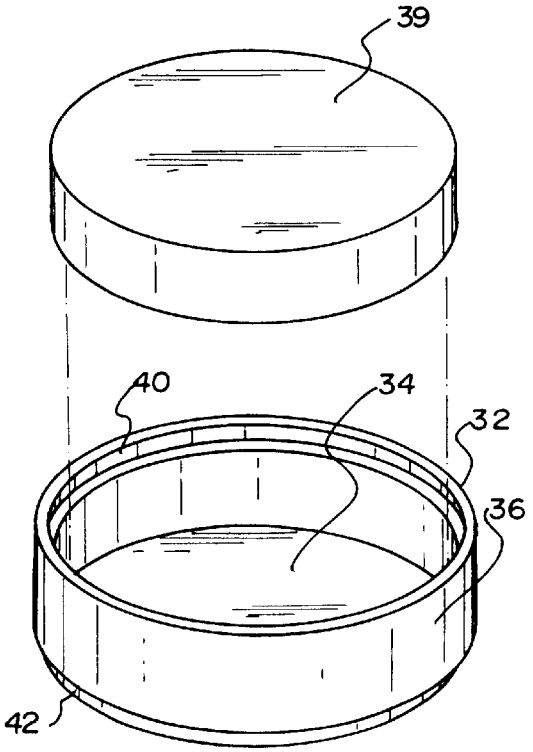
FIG. 2 is a perspective view of one of the molds and an ice puck associated therewith.

With reference now to the drawings, and in particular to FIG. 1 thereof, a new and improved ice puck mold and storage system embodying the principles and concepts of the present invention and generally designated by the reference numeral 10 will be described.

The present invention, the new and improved ice puck mold and storage system, is comprised of a plurality of components. Such components in their broadest context include a container, cap and at least one hockey puck mold. Such components are individually configured and correlated with respect to each other so as to attain the desired objective.

Figure 3:
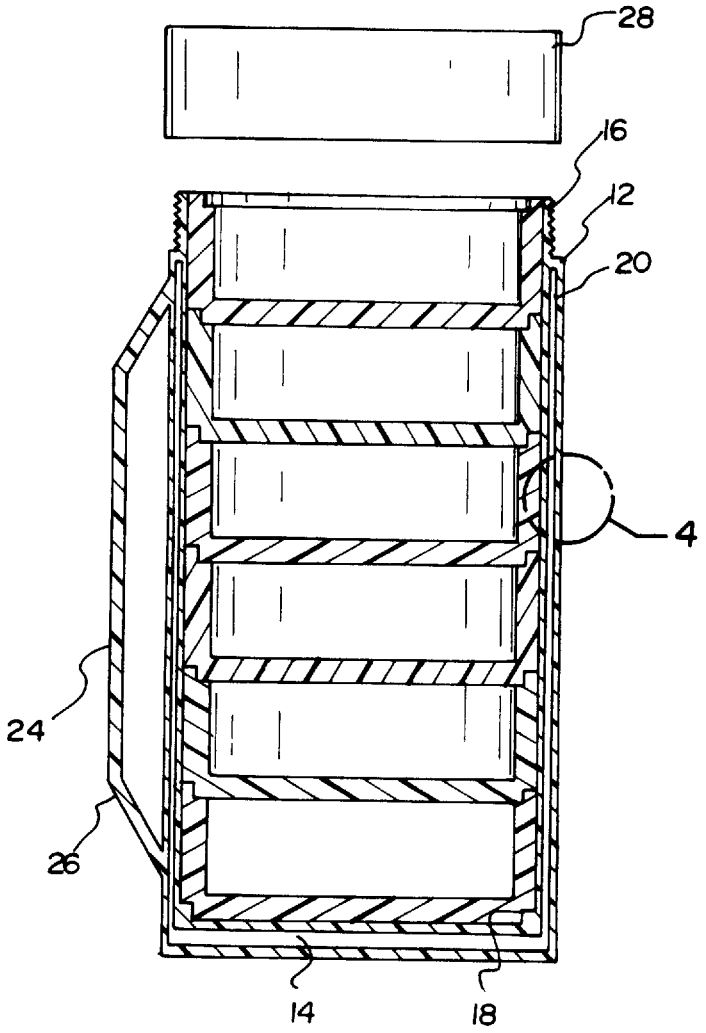
FIG. 3 is a cross-sectional view of the container and molds.
Figure 4:
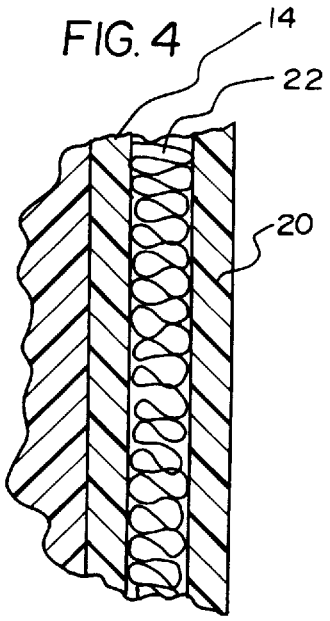
FIG. 4 is a close-up of a portion of the cross-section of FIG. 3.

More specifically, it will be noted that the system 10 of the present invention includes a container 12. As best shown in FIG. 3, the container has an inner extent 14 having a circular bottom and a cylindrical periphery integrally coupled thereto and extending upwardly therefrom. As such, an interior space and an open top face are defined. The periphery of the inner extent has a plurality of threaded grooves 16 formed therein adjacent to the open top face. For reasons that will soon become apparent, an annular flange 18 is integrally mounted to a top surface of the bottom adjacent to the periphery.

The container further includes an outer extent 20 having a circular bottom and a cylindrical periphery integrally coupled thereto and extending upwardly therefrom. The outer extent has an enlarged interior space and an upper peripheral edge integrally coupled to the periphery of the inner extent. Such coupling is effected just below the threaded grooves. By this structure, a uniform space resides between the inner extent and the outer extent. The space is preferably lined with insulation 22.

For carrying purposes, the container further includes a vertically oriented handle 24 comprising an elongated rectangular strip. The strip is mounted to the periphery of the outer extent via a pair of bevelled stanchions 26.

Further provided is a cap 28 having a top face and a periphery extending downwardly therefrom with a plurality of threaded grooves formed therein. The grooves of the cap are thus adapted for removably coupling with those of the container. For facilitating the coupling of the cap with the container, the top face has a rectangular strip 30 integrally coupled thereto.

Finally, a plurality of hockey puck molds 32 are provided each having a planar circular bottom face 34 and a smooth cylindrical periphery 36 integrally coupled thereto and extending upwardly therefrom. An upper peripheral edge, an interior space and an open top are thereby defined. A diameter of the periphery of each mold is about equal to that of the periphery of the inner extent of the container. In the preferred embodiment, each mold has a diameter of about 3 inches and a height 1 and ½ inches. During use, each mold may be filled with water and placed in a freezer such that a ice puck 39 is formed.

For maintaining the molds in a stacked relationship, the periphery of each mold is equipped with an upper peripheral edge having an annular lip 40 integrally coupled thereto and extending upwardly therefrom. The annular lip is situated contiguous with an outer surface of the periphery of the mold and has a reduced thickness as compared to the periphery of the corresponding mold. Associated therewith is a lower annular cutout 42 formed in a bottom edge of the periphery of each mold.

During use, the molds may be slidably situated within the interior space of the inner extent of the container in a stacked relationship. As shown in FIG. 3, the annular lip is removably mounted within the annular cutout of an adjacent mold. Ideally, 6 molds are capable of being situated within the container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ice puck mold and storage system comprising, in combination:

a container including an inner extent having a circular bottom and a cylindrical periphery integrally coupled thereto and extending upwardly therefrom to define an interior space and an open top face, the periphery having a plurality of threaded grooves formed therein adjacent to the open top face and an annular flange mounted to a top surface of the bottom adjacent to the periphery, the container further including an outer extent having a circular bottom and a cylindrical periphery integrally coupled thereto and extending upwardly therefrom, the outer extent having an enlarged interior space and an upper peripheral edge integrally coupled to the periphery of the inner extent just below the threaded grooves such that a uniform space resides between the inner extent and the outer extent, wherein the space between the inner extent and outer extent is lined with insulation, the container further including a vertically oriented handle comprising an elongated rectangular strip mounted to the periphery of the outer extent via a pair of tapering stanchions;

a cap having a top face and a periphery extending downwardly therefrom with a plurality of threaded grooves formed therein for removably coupling with those of the container, the top face of the cap having a rectangular strip integrally coupled thereto for facilitating the coupling of the cap with the container; and a plurality of hockey puck molds each having a circular bottom face and a cylindrical periphery integrally coupled thereto and extending upwardly therefrom for defining an upper peripheral edge, an interior space, and an open top, with a diameter of the periphery of each mold being about equal to that of the periphery of the inner extent of the container, the periphery of each mold having an upper peripheral edge with an annular lip integrally coupled thereto and extending upwardly therefrom contiguously with an outer surface of the periphery of the mold, with the annular lip having a reduced thickness as compared to the periphery of the corresponding mold, the periphery of each mold further having a lower annular cutout formed in a bottom edge thereof, whereby the molds may be slidably situated within the interior space of the inner extent of the container in a stacked relationship, wherein the annular lip is removably mounted within the annular cutout of an adjacent mold.

2. An ice puck mold and storage system comprising:

a container including an inner extent having a circular bottom and a cylindrical periphery integrally coupled thereto, the periphery having threaded grooves adjacent to an open top face thereof, an annular flange mounted to a top surface of a bottom face adjacent to the periphery, the container including an outer extent having a circular bottom and a cylindrical periphery integrally coupled thereto, the outer extent having an enlarged interior space and an upper peripheral edge integrally coupled to the periphery of the inner extent just below the threaded grooves such that a uniform space resides between the inner extent and the outer extent, the uniform space being lined with insulation;

at least one hockey puck mold received within the container with each having a circular bottom face and a cylindrical periphery integrally coupled thereto and extending upwardly therefrom for defining an upper peripheral edge, an interior space, and an open top.

3. An ice puck mold and storage system as set forth in claim 2 wherein the container has a cap.

4. An ice puck mold and storage system as set forth in claim 2 wherein the container has a handle.

5. An ice puck mold and storage system as set forth in claim 2 wherein the container is adapted to receive the molds in a stacked relationship.

6. An ice puck mold and storage system as set forth in claim 2 wherein the molds each have securement means to maintain the molds in a stacked relationship.

7. An ice puck mold and storage system as set forth in claim 2 wherein the periphery of each mold has an upper peripheral edge with an annular lip integrally coupled thereto and extending upwardly therefrom and a lower annular cutout formed in a bottom edge thereof.

* * * * *